US010902791B2

(12) United States Patent
Tung et al.

(10) Patent No.: US 10,902,791 B2
(45) Date of Patent: Jan. 26, 2021

(54) METHOD OF CONTROLLING SOURCE DRIVER AND RELATED DISPLAY SYSTEM

(71) Applicant: NOVATEK Microelectronics Corp., Hsin-Chu (TW)

(72) Inventors: Chia-Hsin Tung, Hsinchu (TW); Chun-Hung Chen, Yun-Lin County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/522,661

(22) Filed: Jul. 26, 2019

(65) Prior Publication Data

US 2020/0226982 A1 Jul. 16, 2020

Related U.S. Application Data

(60) Provisional application No. 62/793,343, filed on Jan. 16, 2019.

(51) Int. Cl.
*G09G 3/3275* (2016.01)

(52) U.S. Cl.
CPC ... *G09G 3/3275* (2013.01); *G09G 2310/0289* (2013.01); *G09G 2310/0291* (2013.01); *G09G 2330/021* (2013.01)

(58) Field of Classification Search
CPC ..... G09G 3/3275
USPC ..... 345/173, 212, 690; 1/1; 370/377; 713/502
See application file for complete search history.

(56) References Cited

U.S. PATENT DOCUMENTS 2,848,544 A * 8/1958 Trousdale ..... H04Q 11/04 370/377
4,270,150 A * 5/1981 Diermann ..... G11B 17/005 360/22
5,805,873 A * 9/1998 Roy ..... G11C 5/066 713/502
6,400,207 B1 * 6/2002 Ivanov ..... G05F 3/262 323/901
2004/0174343 A1 * 9/2004 Chao ..... G06F 3/046 345/173
2008/0303836 A1 * 12/2008 Ludden ..... G09G 3/2092 345/531
2010/0321413 A1 * 12/2010 Weng ..... G09G 3/3688 345/690
2012/0249244 A1 * 10/2012 Chen ..... H03F 3/45183 330/253
2012/0280965 A1 * 11/2012 Lee ..... G09G 3/3677 345/212
2013/0257529 A1 * 10/2013 Komninakis ..... H03F 3/24 330/149
2014/0139558 A1 * 5/2014 Tseng ..... G09G 3/3648 345/690

(Continued)

*Primary Examiner* — Prabodh M Dharia
(74) *Attorney, Agent, or Firm* — Winston Hsu

(57) ABSTRACT

A method of controlling a source driver includes the steps of: detecting a line of image data to be outputted by a plurality of channels of the source driver, to generate a detection result; generating a plurality of control signals according to the detection result, each of the plurality of control signals corresponding to a channel among the plurality of channels; and enabling or disabling an operational amplifier in each of the plurality of channels via one of the plurality of control signals corresponding to the channel.

12 Claims, 11 Drawing Sheets

(56) References Cited

U.S. PATENT DOCUMENTS

| | | | | |
|---|---|---|---|---|
| 2014/0253534 | A1* | 9/2014 | Kim | G09G 3/3688 345/213 |
| 2015/0015551 | A1* | 1/2015 | Honda | G09G 3/3611 345/204 |
| 2016/0163277 | A1* | 6/2016 | Ludden | G09G 3/3607 345/690 |
| 2019/0172386 | A1* | 6/2019 | Bae | G09G 3/3275 |
| 2020/0152115 | A1* | 5/2020 | Tu | G09G 3/2092 |

* cited by examiner

METHOD OF CONTROLLING SOURCE DRIVER AND RELATED DISPLAY SYSTEM

CROSS REFERENCE TO RELATED APPLICATIONS

This application claims the benefit of U.S. Provisional Application No. 62/793,343, filed on Jan. 16, 2019, the contents of which are incorporated herein by reference.

BACKGROUND OF THE INVENTION

1. Field of the Invention

The present invention relates to a method of controlling a source driver and a related display system, and more particularly, to a power saving control method for a source driver and a related display system.

2. Description of the Prior Art

An organic light-emitting diode (OLED) is a light-emitting diode (LED) in which the emissive electroluminescent layer is a film of organic compound, where the organic compound can emit light in response to an electric current. OLEDs are widely used in displays of electronic devices such as television screens, computer monitors, portable systems such as mobile phones, handheld game consoles and personal digital assistants (PDAs). The display operation of a general OLED display, as different from a liquid crystal display (LCD), is not enabled by a backlight source; hence, an electronic device using the OLED display usually operates with an always on display (AOD) mode in standby, to keep showing necessary information such as date, time, and/or power quantity in a small area during an idle time.

A common power saving method for a source driver configures the source driver globally. For example, in the AOD mode, a global bias configuration with lower current is provided for every operational amplifier in the source driver, to reduce the DC power consumption of the source driver. However, there are various types of AOD images used in the display system, and these AOD images are different and have large variety. The AOD configuration has to meet the requirements of any possible AOD images with large variety, and the appropriate configuration should be obtained after verification of these AOD images. The verification has to meet the requirements in the worst case, such that the power consumption configuration may not achieve its optimal settings for normal cases.

Another common power saving method is configuring partial display area in an image frame; that is, the AOD mode has a partial display area for defining the range of the AOD image(s). The area outside the partial display area is the non-display area, for which the operational amplifiers of the source driver may be disabled. In this manner, each horizontal line (H-line) is served as a unit for controlling the operational amplifiers to be turned on or off according to the corresponding area. However, this method has a drawback that it is not effective if the AOD image has a larger contour or occupies a larger range to result in small or even no non-display area. Further, if there are a large variety of AOD images applied to the display device, the display device has to be configured with a great number of different partial display configurations for the AOD images; this generates large burdens on the display product.

Thus, there is a need to provide a novel power saving method to effectively control the configurations of the operational amplifiers to be adapted to various AOD images or normal images.

SUMMARY OF THE INVENTION

It is therefore an objective of the present invention to provide a power saving control method for a source driver and a related display system, which are capable of individually controlling each operational amplifier in the source driver, in order to effectively and flexibly reduce the power consumption based on the image features.

An embodiment of the present invention discloses a method of controlling a source driver. The method comprises the steps of: detecting a line of image data to be outputted by a plurality of channels of the source driver, to generate a detection result; generating a plurality of control signals according to the detection result, each of the plurality of control signals corresponding to a channel among the plurality of channels; and enabling or disabling an operational amplifier in each of the plurality of channels via one of the plurality of control signals corresponding to the channel.

Another embodiment of the present invention discloses a method of controlling a source driver. The method comprises the steps of: detecting a line of image data to be outputted by a plurality of channels of the source driver, to generate a detection result; generating a plurality of control signals according to the detection result, each of the plurality of control signals corresponding to a channel among the plurality of channels; and controlling a bias configuration of the operational amplifier via one of the plurality of control signals corresponding to the channel.

Another embodiment of the present invention discloses a method of controlling a source driver. The source driver comprises a plurality of channels. The method comprises the steps of: detecting a frame of image data to be outputted by the source driver, to generate a detection result; generating a plurality of control signals for a plurality of lines of image data in the frame of image data according to the detection result; and enabling or disabling an operational amplifier in each of the plurality of channels of the source driver by the plurality of control signals for each line among the plurality of lines of image data, respectively. Each of the plurality of control signals is configured to control the operational amplifier in one of the plurality of channels for a line of image data among the plurality of lines of image data.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
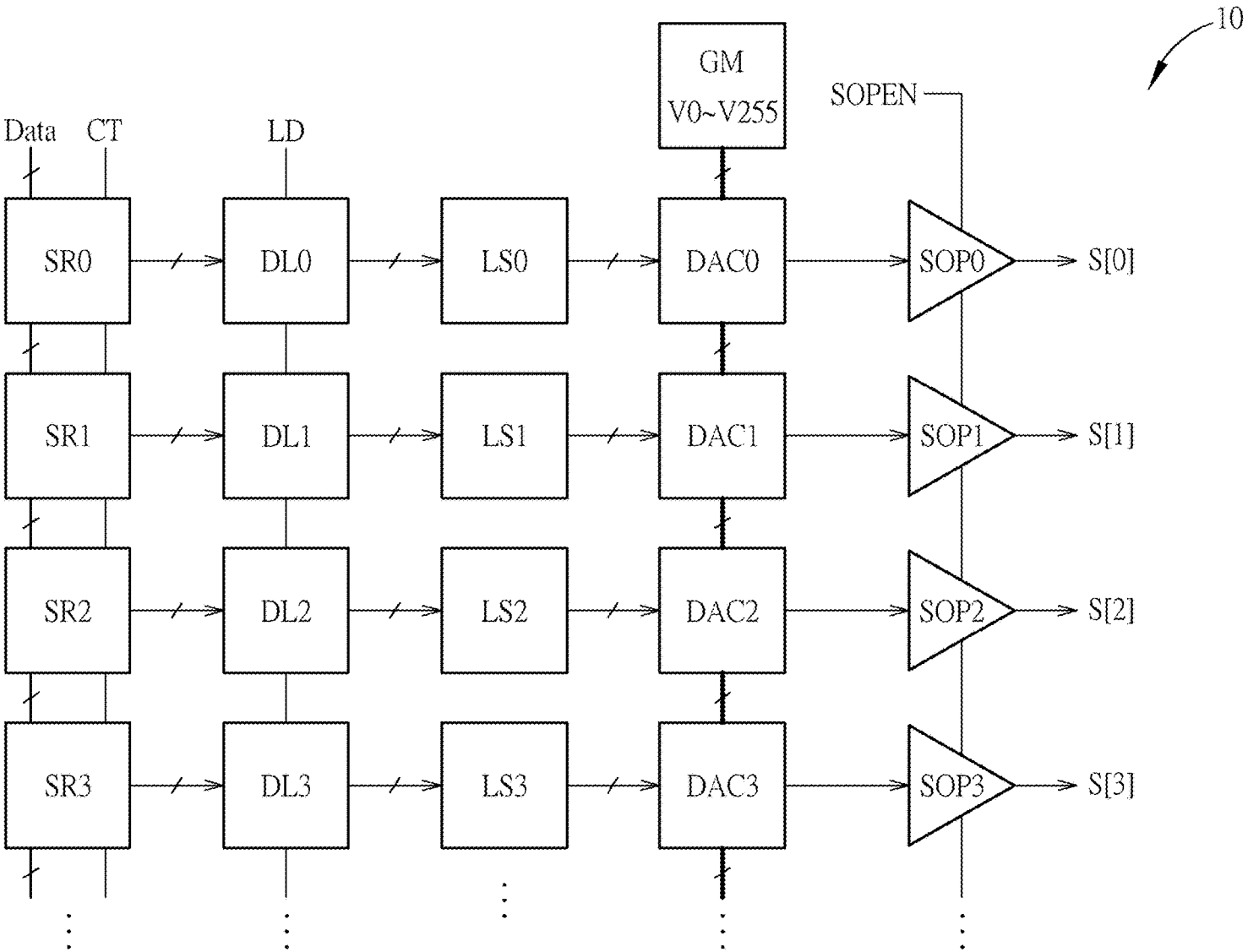
FIG. 1 is a schematic diagram of a general source driver.

Please refer to FIG. 1, which is a schematic diagram of a general source driver 10. As shown in FIG. 1, the source driver 10 includes a plurality of channels, each of which comprises a shift register (SR0, SR1 . . . ), a data latch (DL0, DL1 . . . ), a level shifter (LS0, LS1 . . . ), a digital to analog converter (DAC0, DAC1 . . . ) and an operational amplifier (SOP0, SOP1 . . . ). The source driver 10 may output desired image signals S [0], S [1] . . . by receiving input image data and related control signals CT from a timing controller. In detail, each shift register may respectively receive an image data and the control signals CT from the timing controller. When a load signal (LD) is received, the image data received by the shift registers SR0, SR1 . . . are latched into the data latches DL0, DL1 . . . . Subsequently, the image data in each channel is sent to the level shifter LS0, LS1 . . . , which converts the data from a low voltage to a middle voltage, to be adapted to the voltage level of the follow-up circuits such as the operational amplifier SOP0, SOP1 . . . . The source driver 10 further includes a gamma circuit GM, which provides output voltage levels for the DACs DAC0, DAC1 . . . based on the received data codes. When a DAC receives the image data from the corresponding level shifter, the DAC may select a corresponding gamma voltage V0-V255 from the gamma circuit GM according to the received image data, and send the gamma voltage to the operational amplifier. The operational amplifier SOP0, SOP1 . . . , which is served as a buffer for enhancing the driving capability of the source driver, may output the gamma voltage to a corresponding data line on the display panel.

In the source driver l0, each operational amplifier SOP0, SOP1 . . . is controlled by the same enable signal SOPEN. In order to reduce the power consumption of the source driver 10 in a power saving mode such as an always on display (AOD) mode, the operational amplifiers SOP0, SOP1 . . . may be enabled in the display period and disabled in the non-display period. The enable signal SOPEN is used for controlling the switching of all operational amplifiers SOP0, SOP1 . . . , as may be considered as 1-dimensional power saving control.

However, the 1-dimensional power saving control method may not satisfy the requirements of various AOD images in modern electronic products. Therefore, the present invention provides a power saving control scheme that may detect the image data to determine the operational amplifiers to be enabled or disabled, to realize 2-dimensional power saving control. In the 2-dimensional power saving control scheme, the timing controller may send different control signals to control the operational amplifiers, to respectively control each operational amplifier to be in an enable state or disable state, so as to realize power consumption reduction more flexibly and effectively.

Figure 2:
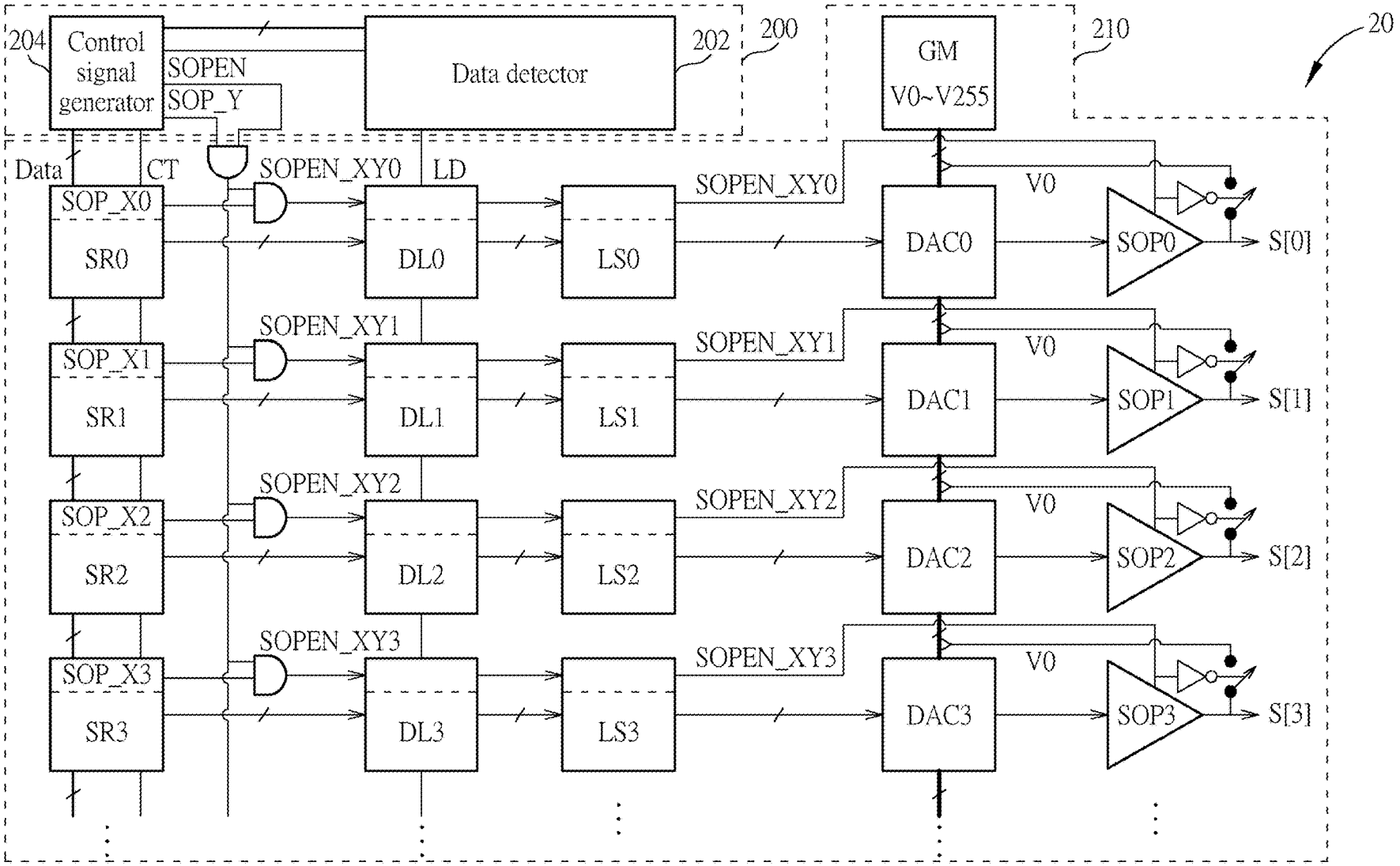
FIG. 2 is a schematic diagram of a display system according to an embodiment of the present invention.

Please refer to FIG. 2, which is a schematic diagram of a display system 20 according to an embodiment of the present invention. As shown in FIG. 2, the display system 20 includes a timing controller 200 and a source driver 210. The timing controller 200 includes a data detector 202 and a control signal generator 204. The data detector 202 is configured to detect image data to be outputted by the channel(s) of the source driver 210. The control signal generator 204 may generate control signal(s) according to the detection result of image data obtained from the data detector 202, and control the configuration of the operational amplifiers in each channel via the corresponding control signal(s). In this embodiment, the control signal may control the operational amplifier to be enabled or disabled according to the content of the image data. In addition, the source driver 210 has a structure similar to the structure of the source driver 10 shown in FIG. 1, so elements and signals having similar functions are denoted by the same symbols. The difference between the source driver 210 and the source driver 10 is that, the source driver 210 further includes a logic circuit for generating the enable control signals SOPEN_XY0, SOPEN_XY1, SOPEN_XY2, SOPEN_XY3 . . . for the operational amplifiers SOP0, SOP1, SOP2, SOP3 . . . . In addition to the data path as similar to those illustrated in FIG. 1, each channel further includes a signal path for transmitting the enable control signal SOPEN_XY0, SOPEN_XY1, SOPEN_XY2, SOPEN_XY3 . . . for controlling each of the operational amplifiers SOP0, SOP1, SOP2, SOP3 . . . to be enabled or disabled, respectively.

In detail, after the data detector 202 generates the detection result according to the image data, the control signal generator 204 may generate and output the control signals accordingly. For each horizontal line of image, the control signal generator 204 may generate a Y-direction control signal SOP_Y. The Y-direction control signal SOP_Y is configured to be "High" if the operational amplifier in at least one channel is determined to be enabled for outputting the image data of the corresponding horizontal line of image; otherwise, the Y-direction control signal SOP_Y is configured to be "Low" if none of the operational amplifiers in the source driver 210 is determined to be enabled for outputting the image data of the corresponding horizontal line of image. For each channel, a corresponding X-direction control signal SOP_X0, SOP_X1, SOP_X2, SOP_X3 . . . is provided, wherein each X-direction control signal is dedicated to control the operational amplifier of the corresponding channel. If the corresponding operational amplifier is determined to be enabled, the X-direction control signal is configured to be "High"; otherwise, if the corresponding operational amplifier is determined to be disabled, the X-direction control signal is configured to be "Low". Each of the enable control signals SOPEN_XY0, SOPEN_XY1, SOPEN_XY2, SOPEN_XY3 . . . for controlling the operational amplifiers SOP0, SOP1, SOP2, SOP3 . . . is generated by combining one of the X-direction control signals SOP_X0, SOP_X1, SOP_X2, SOP_X3 . . . with the Y-direction control signal SOP_Y. For example, the enable control signal SOPEN_XY0 is a combination of the X-direction control signal SOP_X0 and the Y-direction control signal SOP_Y. In this embodiment, the combination is realized by using an AND gate. Therefore, an operational amplifier is enabled only when both of the corresponding X-direction control signal and Y-direction control signal are "High"; otherwise, the operational amplifier is disabled if at least one of the X-direction control signal and Y-direction control signal is "Low". Those skilled in the art should understand that other control logic or circuit may also be adopted to realize the combination of signals.

In addition, in the embodiment as shown in FIG. 2, the enable signal SOPEN outputted by the control signal generator 204 is served as a control signal for enabling the entire power saving function of the display system 20. In detail, the above operations of controlling the operational amplifiers are enabled when the enable signal SOPEN (which is "AND" with the Y-direction control signal SOP_Y) is "High".

Different from the prior art where every operational amplifier in the source driver is controlled by one control signal to achieve the same configuration, in the present invention, the operational amplifier in each source driver is controlled by a respective control signal, which may be generated from a corresponding X-direction control signal or a combination of an X-direction control signal and a Y-direction control signal, so as to realize the 2-dimensional control scheme. As shown in FIG. 2, after the related control signals are obtained based on the image data, the control signal generator 204 may send the X-direction control signals SOP_X0, SOP_X1, SOP_X2, SOP_X3 . . . to the shift registers SR0, SR1, SR2, SR3 . . . , respectively, together with a horizontal line of image data and related control signals CT. Subsequently, the X-direction control signals SOP_X0, SOP_X1, SOP_X2, SOP_X3 . . . are combined with the Y-direction control signal SOP_Y, to generate the enable control signals SOPEN_XY0, SOPEN_XY1, SOPEN_XY2, SOPEN_XY3 . . . , respectively, based on determination of enable range of the data detector 202. The enable control signals SOPEN_XY0, SOPEN_XY1, SOPEN_XY2, SOPEN_XY3 . . . and the corresponding image data are sent to the data latch DL0, DL1, DL2, DL3 . . . in the corresponding channels according to the LD signal. The enable control signals SOPEN_XY0, SOPEN_XY1, SOPEN_XY2, SOPEN_XY3 . . . are then sent to the level shifters LS0, LS1, LS2, LS3 . . . to be shifted from low-level signals into mid-level signals when the corresponding image data are also sent to the level shifters LS0, LSl, LS2, LS3 . . . to be converted into mid-voltage data. The mid-level signals may conform to the voltage level of the operational amplifiers SOP0, SOP1, SOP2, SOP3 . . . , and thus the enable control signals SOPEN_XY0, SOPEN_XY1, SOPEN_XY2, SOPEN_XY3 . . . in the middle voltage level may be applied to control the configurations of the operational amplifiers SOP0, SOP1, SOP2, SOP3 . . . .

In an embodiment, the Y-direction control signal SOP_Y and related circuit elements may be optionally omitted. In such a situation, the X-direction control signals SOP_X0, SOP_X1, SOP_X2, SOP_X3 . . . may be sent to the operational amplifiers SOP0, SOP1, SOP2, SOP3 . . . via the related data latches and level shifters, to control the operational amplifiers SOP0, SOP1, SOP2, SOP3 . . . to be enabled or disabled, respectively. The control signal generator 204 may generate the X-direction control signals SOP_X0, SOP_X1, SOP_X2, SOP_X3 . . . to the dedicated channels, respectively, for each row of image data in each data cycle; hence, the operational amplifiers SOP0, SOP1, SOP2, SOP3 . . . may be well controlled in each row In general, the AOD image merely shows necessary information such as date, time, and/or power quantity in a small area, and thus has a great number of black pixels in an image frame. In order to save power consumption, the power saving control scheme is preferably configured to disable the operational amplifiers responsible for black pixels. Therefore, if the image data to be displayed on a first pixel is determined to be a black image, the corresponding operational amplifier is disabled by receiving the enable control signal in "Low" state. At this moment, the enable control signal may further turn on a switch connected between the channel output terminal and the gamma circuit GM, allowing the channel to output a voltage level corresponding to the black image from the gamma circuit GM without passing through the operational amplifier. Meanwhile, the output of the operational amplifier is in a high impedance state. In this embodiment, the voltage level corresponding to the black image is V0. The V0 voltage is provided from the gamma circuit GM via the signal path bypassing the operational amplifier, allowing the black pixel to maintain its gray level while the corresponding operational amplifier is disabled for power saving. If the image data to be displayed on a second pixel is determined to be an image other than the black image (e.g., with any voltage among V1-V255), the corresponding operational amplifier is enabled by receiving the enable control signal in "High" state. At this moment, the V0 voltage path directly connected between the gamma circuit GM and the channel is cut off. The image data and the corresponding output voltage are sent normally for the second pixel; that is, the DAC may select a corresponding gamma voltage based on the image data and the operational amplifier may output the selected gamma voltage.

As can be seen, the enable control signals for controlling the operational amplifiers are generated according to the image data in the corresponding pixels. In other words, an enable control signal for controlling the operational amplifier of a channel is independent to another enable control signal for controlling the operational amplifier of another channel. Therefore, the operational amplifier in each channel may be controlled independently to be enabled or disabled based on the corresponding image data, to achieve the flexibility of power saving control without influencing the image quality.

Figure 3B:
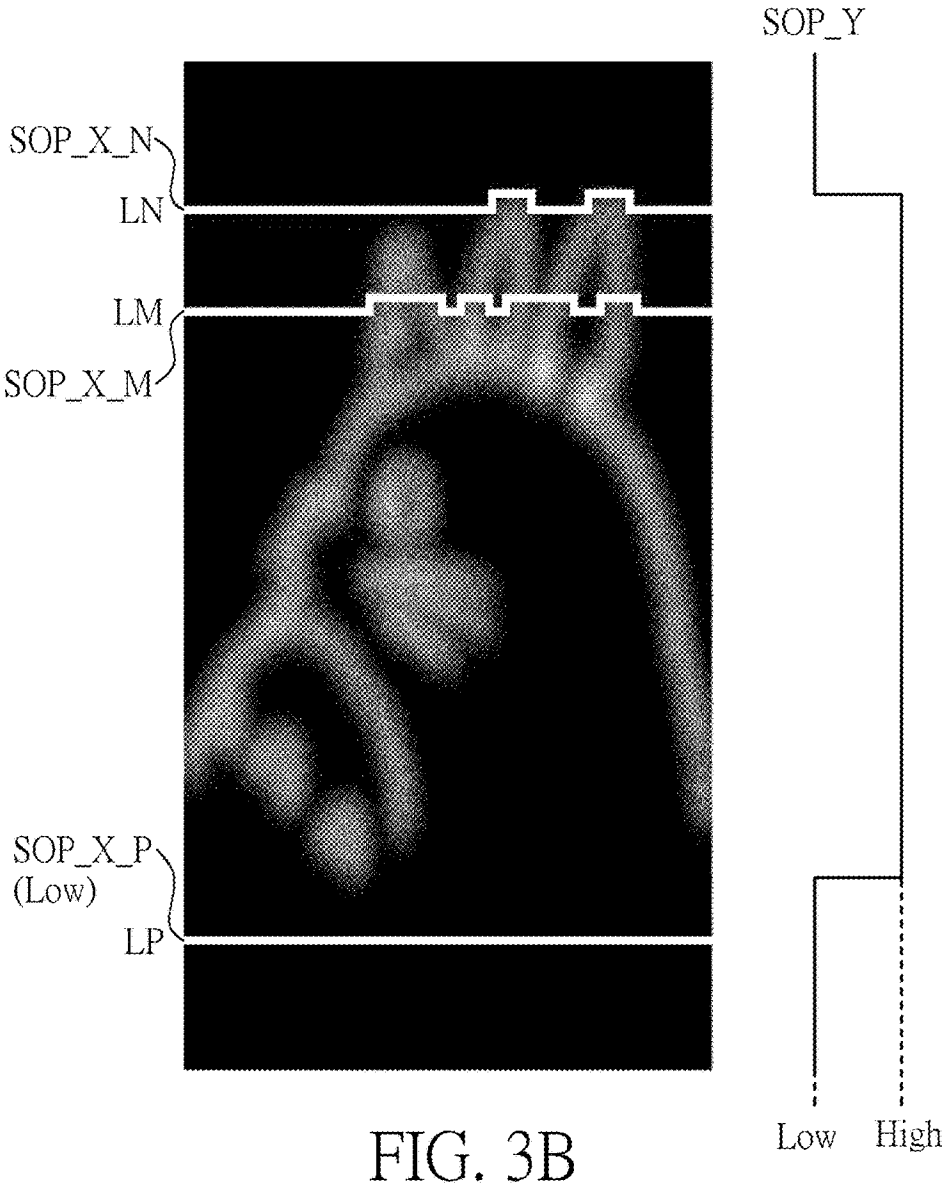
FIG. 3B illustrates an exemplary signal processing method applied to the AOD image shown in FIG. 3A.
Figure 3A:
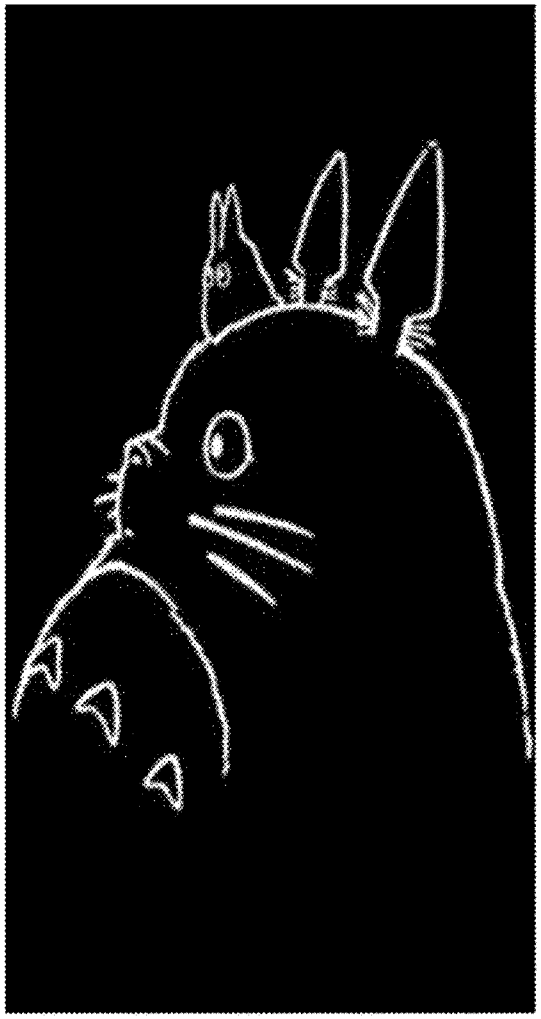
FIG. 3A is a schematic diagram of an AOD image according to an embodiment of the present invention.

For example, please refer to FIG. 3A, which is a schematic diagram of an AOD image according to an embodiment of the present invention. FIG. 3B illustrates an exemplary signal processing method applied to the AOD image shown in FIG. 3A. In this embodiment, the original image is converted to a blurred image and the data detector 202 determines to enable or disable the operational amplifiers based on the blurred image as shown in FIG. 3B. The blurred image is analyzed to generate the corresponding X-direction control signal (or together with the Y-direction control signal) for each channel and each line data. The purpose of blurring the image is to allow the borders of enabled operational amplifiers cover small parts of the black area of the original picture, where the operational amplifiers may be enabled earlier. In general, there may be a limitation on the reaction speed of the operational amplifiers. The earlier enable time allows the operational amplifiers to be fully enabled and turned on when the image data requiring output driving arrive, so that the operational amplifiers may operate to drive the output images other than the black image. It is noted that the blurring operation performed on the display image is optional. In another embodiment, if the reaction speed of the operational amplifiers is fast enough, the blurring operation before image data detection may not be performed.

As shown in FIGS. 3A-3B, the AOD image includes two colors: white and black, where the operational amplifier is disabled when the black image is outputted and the operational amplifier is enabled when the white image is outputted. Note that the white image forming the picture may be replaced by any other possible colors other than black or a combination of multiple colors.

In this embodiment, for line data LN, there are several white image data to be outputted, and the operational amplifiers in the corresponding channels may be enabled and other operational amplifiers may be disabled. To achieve this, the control signal generator 204 may output the Y-direction control signal SOP_Y as "High", and output the X-direction control signals SOP_X0, SOP_X1 . . . as the signal distribution SOP_X_N, where the X-direction control signals corresponding to the white image are "High" and the X-direction control signals corresponding to the black image are "Low". For line data LM, there are more white image data in this line, and the operational amplifiers in the channels outputting white image may be enabled and other operational amplifiers may be disabled. To achieve this, the control signal generator 204 may output the Y-direction control signal SOP_Y as "High", and output the X-direction control signals SOP_X0, SOP_X1 . . . as the signal distribution SOP_X_M, where the X-direction control signals corresponding to the white image are "High" and the X-direction control signals corresponding to the black image are "Low". As shown in FIG. 3B, there are more white pixel data in the line data LM; hence, the operational amplifiers in more channels are enabled. For line data LP, there is no white image data to be outputted; that is, all pixel data in the line are black. Therefore, all operational amplifiers in the source driver should be disabled. To achieve this, the control signal generator 204 may output the Y-direction control signal SOP_Y as "Low", and the X-direction control signals SOP_X0, SOP_X1 . . . may be in any level without influencing the configurations of the operational amplifiers. Alternatively, if the Y-direction control signal SOP_Y is omitted, the X-direction control signals SOP_X0, SOP_X1 . . . may be outputted as "Low", in order to disable all of the operational amplifiers SOP0, SOP1 . . . for the line data LP. As can be seen, each operational amplifier may be configured to be enabled or disabled for each line data. Therefore, the power consumption effects may become more satisfactory since the corresponding operational amplifiers may be disabled for most or all black areas in the AOD image.

In the conventional 1-dimensional power saving control method, all operational amplifiers in the source driver are controlled by a global control signal, which can only realize two states: all-enabled and all-disabled. In such a situation, power saving may be realized for the line data having all black pixel data where all operational amplifiers are disabled, such as several upper lines and lower lines in the AOD image shown in FIGS. 3A-3B. If the AOD image includes small points or objects scattered in the entire picture such as a picture of starry sky, the 1-dimensional power saving control method may not achieve preferable power saving performance since there may be small and no non-display area where operational amplifiers may be disabled. In comparison, according to the power saving control method of the present invention, the 2-dimensional power saving control allows each operational amplifier to be configured independently; hence, the power saving control method of the present invention is adaptive to any type of AOD image based on image data detection for the image content.

In general, in the source driver, most power consumption comes from the operational amplifier in each output channel. By using the method of configuring the operational amplifiers proposed by the present invention, several operational amplifiers may be disabled for the black pixels in the display image, which significantly reduces the entire power consumption of the source driver, especially for the AOD image having larger black areas. Those skilled in the art should understand that the embodiments of the present invention are not limited thereto. For example, the method of configuring the operational amplifiers is also applicable to image frames other than the AOD image.

Figure 4:
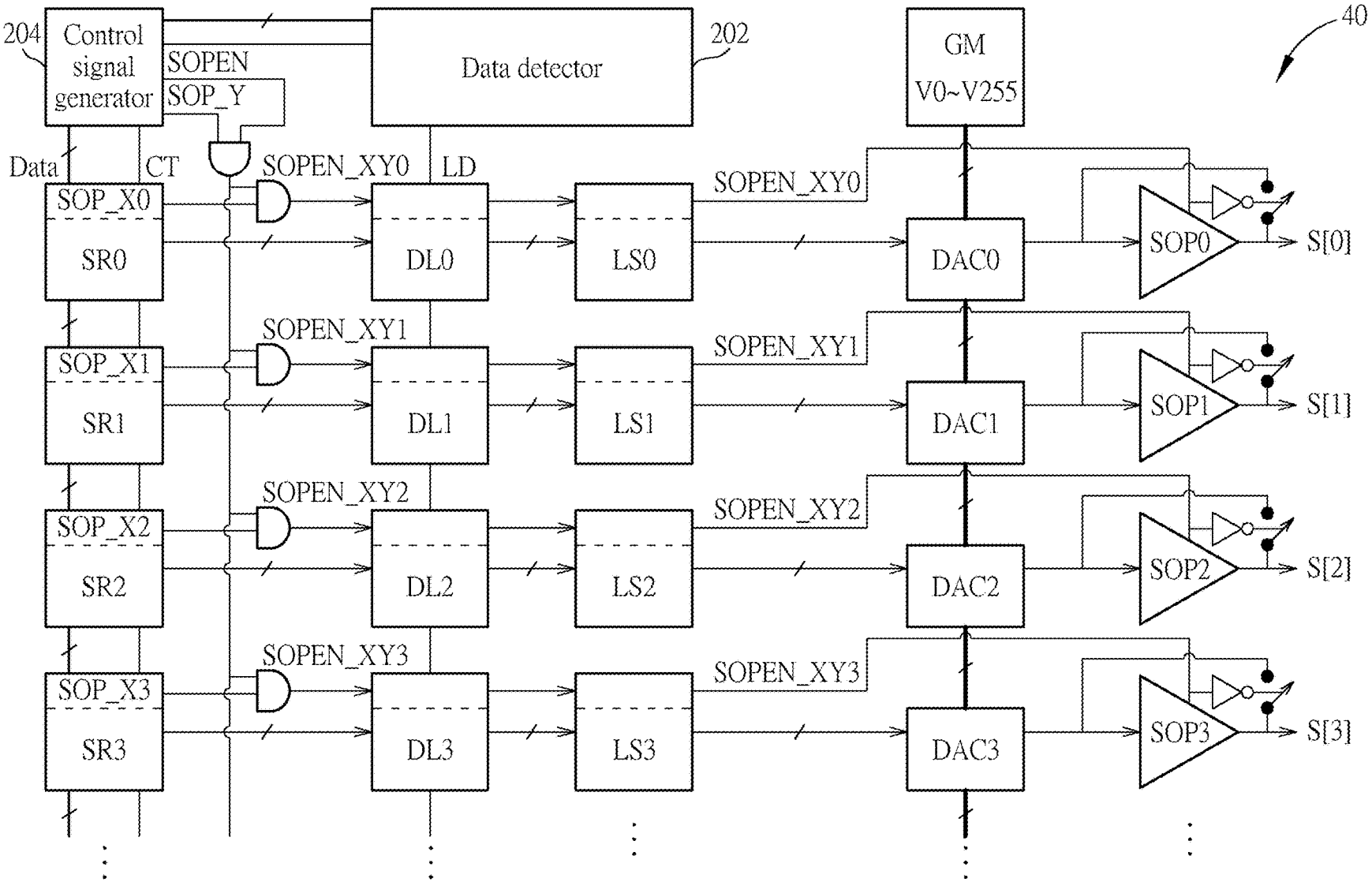
FIG. 4 is a schematic diagram of a display system according to an embodiment of the present invention.

Please refer to FIG. 4, which is a schematic diagram of a display system 40 according to an embodiment of the present invention. As shown in FIG. 4, the structure of the display system 40 is similar to the structure of the display system 20 shown in FIG. 2, so signals and elements having similar functions are denoted by the same symbols. The display system 40 is different from the display system 20 in that, in the display system 40, the channel output terminal is connected to the DAC and the output of the operational amplifier is configured to be in a high impedance state when the operational amplifier is disabled. That is, for the area of image where the operational amplifier is configured to be disabled, the channel may output an image data having any voltage value (including the black image or any other colors) from the DAC to the panel, i.e., by bypassing the operational amplifier.

In this embodiment as shown in FIG. 4, the detection of the data detector 202 is not limited to the black image. Instead, the data detector 202 is configured to detect the data variations or data changes. For example, if there is no data variation in the channel for a specific pixel, the corresponding operational amplifier may be configured to be disabled. Note that with absence of data variation in the channel, the data line corresponding to the channel needs not to be provided with large driving capability, and the DAC output is able to drive the data line to maintain the data line at the constant level. In such a situation, the operational amplifier may be disabled to save power consumption. On the other hand, if a data variation is detected, the corresponding operational amplifier may be configured to be enabled, in order to provide sufficient driving capability to drive the data line to reach another voltage level corresponding to the newly arrived data.

Therefore, the data detector 202 may compare the image data in the current data line with the image data in the previous data line outputted by the same channel, so as to detect whether the image data changes. The control signal generator 204 may thereby output the X-direction control signal (or together with the Y-direction control signal) to control the configuration of the operational amplifier based on the detection result of data changes. In detail, if the data detector 202 detects that the image data in the current data line is identical to the previous image data in the previous data line outputted by the same channel, the control signal generator 204 may determine that the data line needs to remain unchanged, and the corresponding enable control signal may be "Low" which controls the operational amplifier to be disabled. The image data to be outputted by the channel may be provided from the gamma voltage and the DAC without passing through the operational amplifier, to maintain the voltage level of the data line. If the data detector 202 detects that the image data has a data change, the control signal generator 204 may determine that the data line needs to be driven to another level, and the corresponding enable control signal may "High" which controls the operational amplifier to be enabled. Therefore, the operational amplifier may drive the data line to reach its target voltage level.

In another embodiment, the image data in the current data line does not need to be exactly identical to the previous image data in the previous data line for the disable configuration. For example, the control signal generator 204 may control the operational amplifier to be disabled and the image data is outputted from the DAC without passing through the operational amplifier if the variation of the image data is less than a threshold; that is, the difference between the current image data and the previous image data is less than a threshold. If the data variation is small, it is possible that the data line may still reach its target voltage level within a predetermined charging time when driven by the DAC without the usage of operational amplifier. In such a situation, the operational amplifier may be disabled to save power consumption.

Since the data detector 202 is configured to detect the data changes, the power saving control method may be applied to control the operational amplifiers for an AOD image or a normal image. Note that most areas in a picture shown on the panel may have continuity, which means that the difference of gray level data between two consecutive horizontal lines may be small. In such a situation, the operations that the DAC drives the data line to reach its target voltage level and that the operational amplifier is correspondingly disabled may lead to the benefits of power reduction in most images.

In another embodiment, the operational amplifiers in the source driver may not be disabled or turned off; instead, the bias configurations of the operational amplifiers may be well controlled, where the bias current of several or all operational amplifiers may be reduced to realize power saving.

Figure 5:
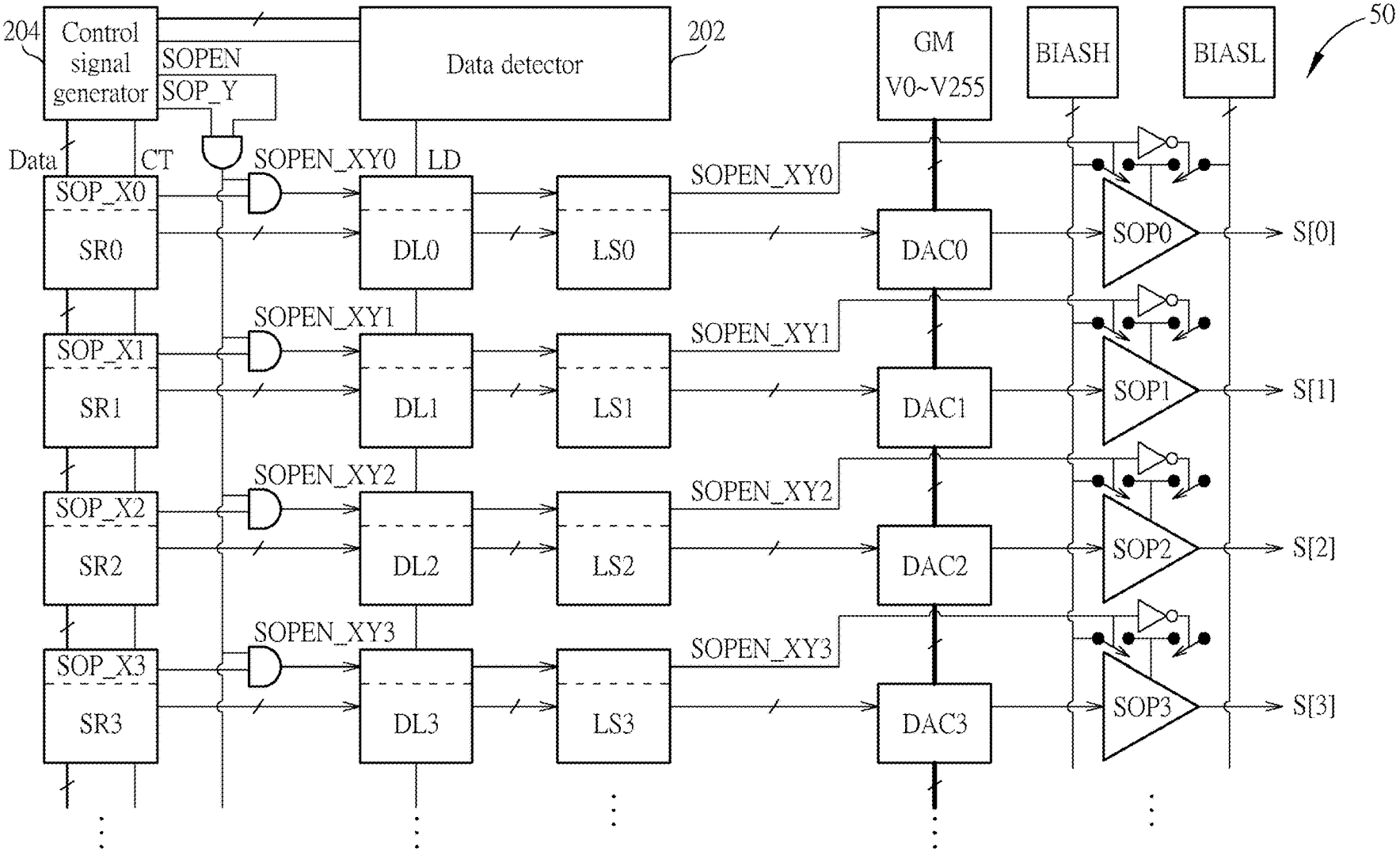
FIG. 5 is a schematic diagram of a display system according to an embodiment of the present invention.

Please refer to FIG. 5, which is a schematic diagram of a display system 50 according to an embodiment of the present invention. As shown in FIG. 5, the structure of the display system 50 is similar to the structure of the display system 40 shown in FIG. 4, so signals and elements having similar functions are denoted by the same symbols. The display system 50 is different from the display system 40 in that, in the display system 50, there is no bypass path bypassing the operational amplifier, but the operational amplifier is controlled by each of the bias control signals BIAS_XY0, BIAS_XY1, BIAS_XY2, BIAS_XY3 . . . , to be connected to a high bias source BIASH or a low bias source BIASL.

In detail, after the data detector 202 generates the detection result according to the image data, the control signal generator 204 may generate and output the control signals accordingly. For each horizontal line of image, the control signal generator 204 may generate a Y-direction control signal SOP_Y. The Y-direction control signal SOP_Y is configured to be "High" if the operational amplifier in at least one channel is determined to have high bias current for outputting the corresponding horizontal line of image. Otherwise, the Y-direction control signal SOP_Y is configured to be "Low" if none of the operational amplifiers in the source driver 210 is determined to have high bias current for outputting the corresponding horizontal line of image; that is, the operational amplifier in each channel is determined to have low bias current. For each channel, a corresponding X-direction control signal SOP_X0, SOP_X1, SOP_X2, SOP_X3 . . . is provided, wherein each X-direction control signal is dedicated to control the operational amplifier of the corresponding channel. If the corresponding operational amplifier is determined to have high bias current, the X-direction control signal is configured to be "High"; otherwise, if the corresponding operational amplifier is determined to have low bias current, the X-direction control signal is configured to be "Low". Each of the bias control signals BIAS_XY0, BIAS_XY1, BIAS_XY2, BIAS_XY3 . . . for controlling the operational amplifiers SOP0, SOP1, SOP2, SOP3 . . . may be respectively generated from the corresponding X-direction control signal SOP_X0, SOP_X1, SOP_X2, SOP_X3 . . . or generated by combining the corresponding X-direction control signal SOP_X0, SOP_X1, SOP_X2, SOP_X3 . . . with the Y-direction control signal SOP_Y. For example, the bias control signal BIAS_XY0 is a combination of the X-direction control signal SOP_X0 and the Y-direction control signal SOP_Y. Since each operational amplifier receives respective bias control signal, the operational amplifier in each channel may be controlled independently to be connected to the high bias source BIASH or the low bias source BIASL based on the corresponding image data, to achieve the flexibility of power saving control.

As shown in FIG. 5, after the related control signals are obtained based on the image data, the control signal generator 204 may send the X-direction control signals SOP_X0, SOP_X1, SOP_X2, SOP_X3 . . . to the shift registers SR0, SR1, SR2, SR3 . . . , respectively, together with a horizontal line of image data and related control signals CT. Subsequently, the X-direction control signals SOP_X0, SOP_X1, SOP_X2, SOP_X3 . . . are combined with the Y-direction control signal SOP_Y, to generate the bias control signals BIAS_XY0, BIAS_XY1, BIAS_XY2, BIAS_XY3 . . . , respectively, based on determination of bias configuration from the data detector 202. The bias control signals BIAS_XY0, BIAS_XY1, BIAS_XY2, BIAS_XY3 . . . and the corresponding image data are sent to the data latch DL0, DL1, DL2, DL3 . . . in the corresponding channels according to the LD signal. The bias control signals BIAS_XY0, BIAS_XY1, BIAS_XY2, BIAS_XY3 . . . are then sent to the level shifters LS0, LS1, LS2, LS3 . . . to be shifted from low-level signals into mid-level signals when the corresponding image data are also sent to the level shifters LS0, LS1, LS2, LS3 . . . to be converted into mid-voltage data. The mid-level signals may conform to the voltage level of the operational amplifiers SOP0, SOP1, SOP2, SOP3 . . . , and thus the bias control signals BIAS_XY0, BIAS_XY1, BIAS_XY2, BIAS_XY3 . . . in the middle voltage level may be applied to control the bias configurations of the operational amplifiers SOP0, SOP1, SOP2, SOP3 . . . .

Similarly, in an embodiment, the Y-direction control signal SOP_Y and related circuit elements may be optionally omitted. In such a situation, the X-direction control signals SOP_X0, SOP_X1, SOP_X2, SOP_X3 . . . may be sent to the operational amplifiers SOP0, SOP1, SOP2, SOP3 . . . via the related data latches and level shifters, to control the bias configurations of the operational amplifiers SOP0, SOP1, SOP2, SOP3 . . . , respectively.

In this embodiment as shown in FIG. 5, the data detector 202 is configured to detect the data variations or data changes. For example, if there is no data variation or small data variation in the channel for a specific pixel, the corresponding operational amplifier may be configured to have low bias current and thus receive bias signals from the low bias source BIASL, where the bias signals may generate lower bias currents. Note that with absence of data variation in the channel, the data line corresponding to the channel needs not to be provided with large driving capability, and the low bias configuration of the operational amplifier is able to drive the data line to maintain at the constant level. In such a situation, the operational amplifier may be configured to have lower bias current to save power consumption. On the other hand, if a larger data variation is detected, the corresponding operational amplifier may be configured to have high bias current and thus receive bias signals from the high bias source BIASH, where the bias signals may generate higher bias currents, in order to provide sufficient driving capability to drive the data line to reach another voltage level corresponding to the newly arrived data.

Therefore, the data detector 202 may compare the image data in the current data line with the image data in the previous data line outputted by the same channel, so as to detect whether the image data changes or detect the degree of data variation. The control signal generator 204 may thereby output the X-direction control signal (or together with the Y-direction control signal) to control the bias configuration of the operational amplifier based on the detection result. In detail, if the data detector 202 detects that the image data in the current data line is identical to the previous image data in the previous data line outputted by the same channel or the difference between the current image data and the previous image data is less than a threshold, the control signal generator 204 may determine that the data line needs to remain unchanged or has a small change, and the corresponding bias control signal may be "Low" which controls the operational amplifier to be connected to the low bias source BIASL. If the data detector 202 detects that the image data has a larger data change, the control signal generator 204 may determine that the data line needs to be driven to a further level, and the corresponding bias control signal may be "High" which controls the operational amplifier to be connected to the high bias source BIASH. The operational amplifier having higher bias currents may have larger driving capability to drive the data line to reach its target voltage level.

Please note that the present invention aims at providing a power saving control method that individually controls each of the operational amplifiers in the source driver to be enabled or disabled or to have higher or lower bias currents, so as to flexibly save power consumption based on the received image data. Those skilled in the art may make modifications and alternations accordingly. For example, in the embodiments of the present invention, each of the enable control signals SOPEN_XY0, SOPEN_XY1 . . . or the bias control signals BIAS_XY0, BIAS_XY1 . . . is sent to a shift register, a data latch and a level shifter as similar to the image data flow in the channel. These modules (i.e., the shift register, the data latch and the level shifter) may be configured with a data part responsible to process the image data and a signal part responsible to process the control signal. Alternatively, the enable control signals SOPEN_XY0, SOPEN_XY1 . . . and/or the bias control signals BIAS_XY0, BIAS_XY1 . . . may be sent to and processed by a shift register, a data latch and a level shifter independent to the shift register, the data latch and the level shifter for processing the image data in the channel. In addition, the gamma circuit GM included in the source driver aims at providing output voltages for the channel output based on the image data. The gamma circuit GM may be implemented as a digital gamma circuit or an analog gamma circuit, which should not be a limitation of the scope of the present invention. Further, in the embodiment as shown in FIG. 2, the gamma circuit GM directly outputs the voltage V0 to the channel output terminal when the operational amplifier is disabled, where the voltage V0 may be the lowest output voltage of the gamma circuit GM. In another embodiment, the source driver may be applied to a PMOS organic light-emitting diode (OLED) panel, where the black image corresponds to the highest voltage V255. Correspondingly, the gamma circuit GM may directly output the voltage V255 to the channel output terminal when the black image is detected and the operational amplifier is disabled, in order to satisfy power saving requirements for the AOD image.

As long as the power saving control method performs data detection on the image data to generate the control signals which control the configurations of output operational amplifiers of the source driver, the control method should be within the scope of the present invention.

Figure 6:
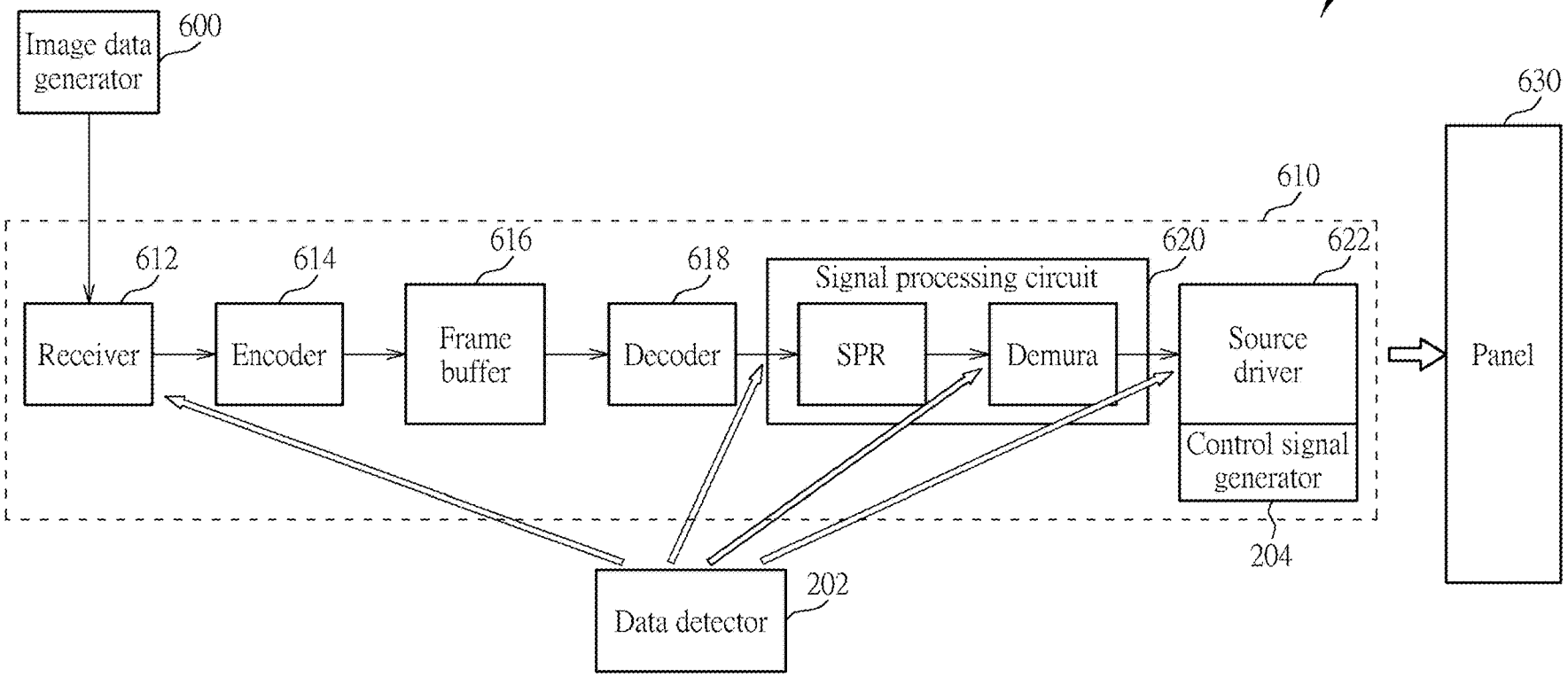
FIG. 6 is a schematic diagram of an image processing system according to an embodiment of the present invention.

It should also be noted that the power saving control method of the present invention may be implemented in any places on the transmission path of the image data. For example, please refer to FIG. 6, which is a schematic diagram of an image processing system 60 according to an embodiment of the present invention. As shown in FIG. 6, the image processing system 60 includes an image data generator 600, an image processing device 610 and a display panel 630. In detail, the image processing device 610 includes a receiver 612 such as a mobile industry processor interface (MIPI) receiver, an encoder 614, a frame buffer 616, a decoder 618, a signal processing circuit 620 and a source driver 622. In an embodiment, the receiver 612, the encoder 614 the frame buffer 616, the decoder 618 and the signal processing circuit 620 may be integrated into a timing controller.

In detail, the image data generator 600 may generate image data and output the image data to the image processing device 610. In the image processing device 610, the image data is compressed by the encoder 614 and then stored in the frame buffer 616 after compression. When the image data needs to be displayed, it is read out from the frame buffer 616 and decompressed by the decoder 618. Subsequently, the image data undergoes several signal processing techniques such as subpixel rendering (SPR) and demura operations in the signal processing circuit 620, and then be forwarded to the source driver 622. The SPR operation allows the colors in three subpixels to be realized in two subpixels, so that the subpixel number may be reduced and the dots per inch (DPI) of the display panel 630 may be increased. The demura operation aims at compensating the Mura defects and thereby increasing the image quality. Finally, the image data is sent to the corresponding channel of the source driver 622 and then outputted to the display panel 630 to be displayed.

In order to realize the power saving control method of the present invention, the image processing system 60 may further include a data detector and a control signal generator such as the data detector 202 and the control signal generator 204 described in the above embodiments. As shown in FIG. 6, the control signal generator 204 may be integrated in the source driver 622 or connected to the source driver 622, to send the X-direction control signals and Y-direction control signals to control the operational amplifiers in the source driver 622. The data detector 202 may be implemented in any position on the data path, such as between the receiver 612 and the encoder 614, between the decoder 618 and the signal processing circuit 620, inside the signal processing circuit 620, or between the signal processing circuit 620 and the source driver 622, as shown in FIG. 6. Preferably, the data detector 202 may be implemented in the timing controller that comprises the modules shown in FIG. 6.

The detect point may be predetermined based on system requirements, and storage of the information of detection results may be provided accordingly. For example, if the data detector 202 is implemented between the receiver 612 and the encoder 614, the detection results may be obtained after the receiver 612 receives the image data. The information related to the detection results may be stored in the memory. If the image data is a still image to be displayed for a period of time, the detection results may be continuously sent to the control signal generator 204 from the memory without additional detection efforts. In an embodiment, the memory size may not be enough to store the detection results for every pixel in an image frame. In such a situation, the control scheme may be simplified. For example, every two operational amplifiers may share one control signal, in order to reduce the information quantity by half. In another embodiment, if the data detector 202 is implemented after the decoder 618, the detection results may be obtained every time when the image data is received from the frame buffer 616 and decoded. The related control signals may be determined based on the image data before or after processing of the signal processing circuit 620 according to the implementations of the data detector 202.

In the above embodiments, the data detector 202 and related detection operations are implemented in the timing controller. Since the timing controller is usually responsible to modify the original image data to perform power saving control and/or image quality enhancement, the data detection results may be generated correspondingly by comparing pixel data if the data detector 202 is implemented in the timing controller. In another embodiment, the data detector 202 may be implemented in the image data generator 600 or an image source. In such an implementation, a configuration of control signals may be predefined for a specific image frame, and several common image frames may have their power saving configurations for controlling the operational amplifiers. However, the predefined configurations may not be applicable to other image frames; this limits the flexibility of power saving control.

In an embodiment, the data detector 202 may detect an image frame to determine the values of the X-direction control signals and the Y-direction control signals, allowing the control signal generator 204 to generate the enable or bias control signals for controlling the output operational amplifiers of the source driver for an entire image frame. The image frame may be an AOD image shown in the idle mode or a general static image lasting for a period of time. When the image frame keeps displayed on the panel, the determined control signal setting may be continuously applied to control the operational amplifiers for the image frame. When the AOD mode is released or the image changes, new image data may arrive and the data detector 202 starts to detect the new image data and the control signal generator 204 correspondingly generates new control signal settings for displaying the new image. In an embodiment, when the new image data arrives, the power saving control may be interrupted (returning to a normal mode where all operational amplifiers are enabled and receive normally high bias currents). The interruption operation avoids that the new image is displayed based on old control signal settings and thus generate improper statuses of operational amplifiers when the data detection for new image has not been finished. The power saving control may be restarted based on the new image data after the new image data is fully received and the related control signal settings are accomplished. The influence of the short-term interruption of power saving control on power consumption may be small and ignorable.

In order to reduce the fan-out wires from the source driver to the panel and reduce the chip area of the source driver IC, a time division scheme is usually applied to in turn drive two or more subpixels by one source channel. For example, an implementation of one operational amplifier of the source driver driving two columns of subpixels is called 2SSD, and an implementation of one operational amplifier of the source driver driving three columns of subpixels is called 3SSD. The power saving control method of the present invention may also be feasible in these structures.

Figure 7:
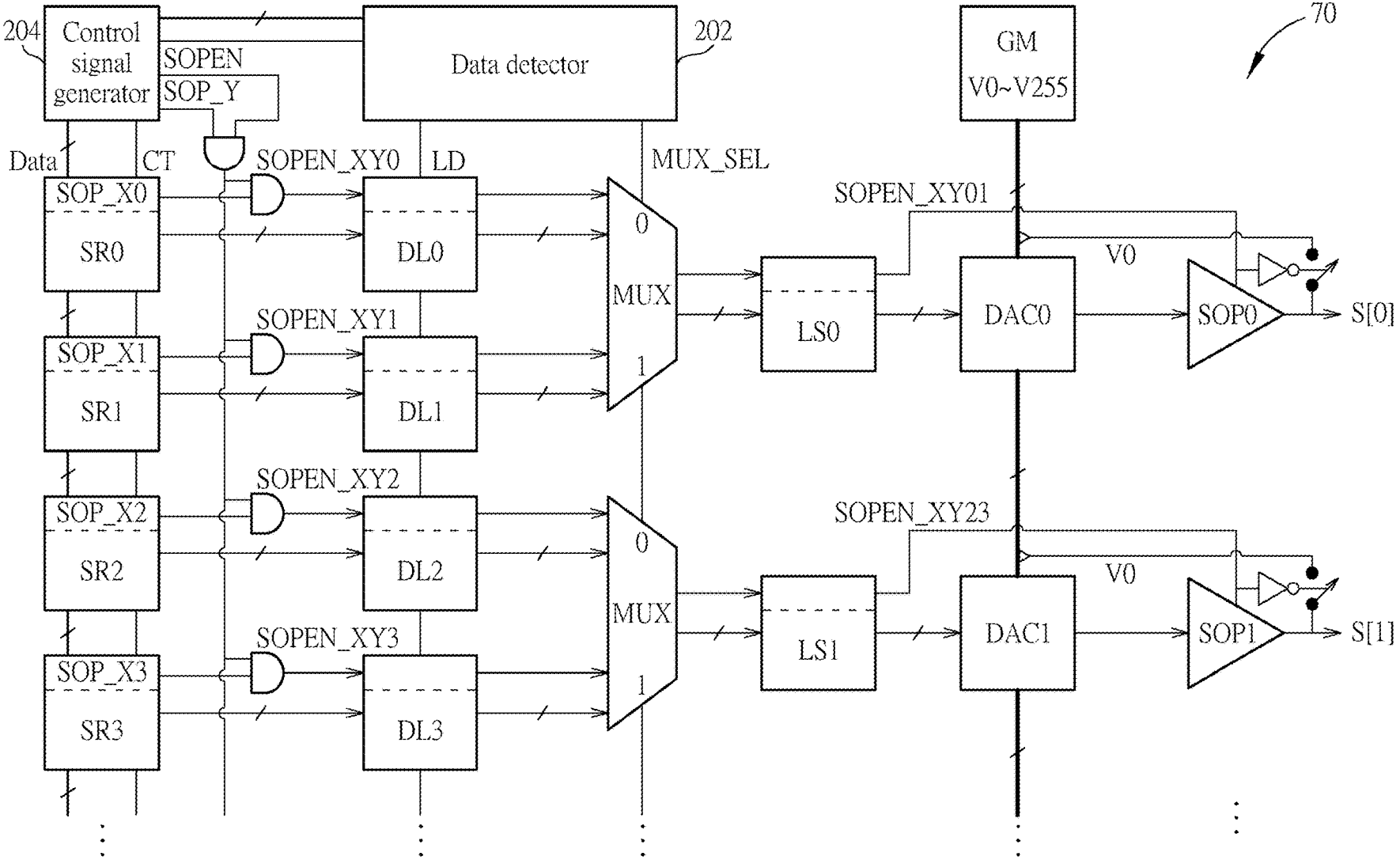
FIG. 7 is a schematic diagram of a display system according to an embodiment of the present invention.

Please refer to FIG. 7, which is a schematic diagram of a display system 70 according to an embodiment of the present invention. As shown in FIG. 7, the structure of the display system 70 is similar to the structure of the display system 20 shown in FIG. 2, so signals and elements having similar functions are denoted by the same symbols. The display system 70 is different from the display system 20 in that, two channels share the same level shifter, DAC and operational amplifier. A multiplexer (MUX) is disposed between the data latches and the level shifter, to select to output image data and corresponding control signal from one of the channels based on a control signal MUX SEL. The structure of two channels sharing the same operational amplifier is able to realize the 2SSD operation.

In this embodiment, the implementations are similar to those described in FIG. 2; that is, each operational amplifier may be enabled or disabled by an enable control signal (SOPEN_XY01, SOPEN_XY23 . . . ) generated by combining an X-direction control signal (SOP_X0, SOP_X1, SOP_X2, SOP_X3 . . . ) and a Y-direction control signal (SOP_Y) with selection of the MUX. Note that the structure of two channels sharing the same operational amplifier may also be applicable to other control methods such as those illustrated in FIG. 4 or FIG. 5. Also, the Y-direction control signal SOP_Y in this embodiment may be omitted, and the operational amplifiers may be controlled by the X-direction control signals SOP_X0, SOP_X1, SOP_X2, SOP_X3 . . . , respectively.

Figure 8:
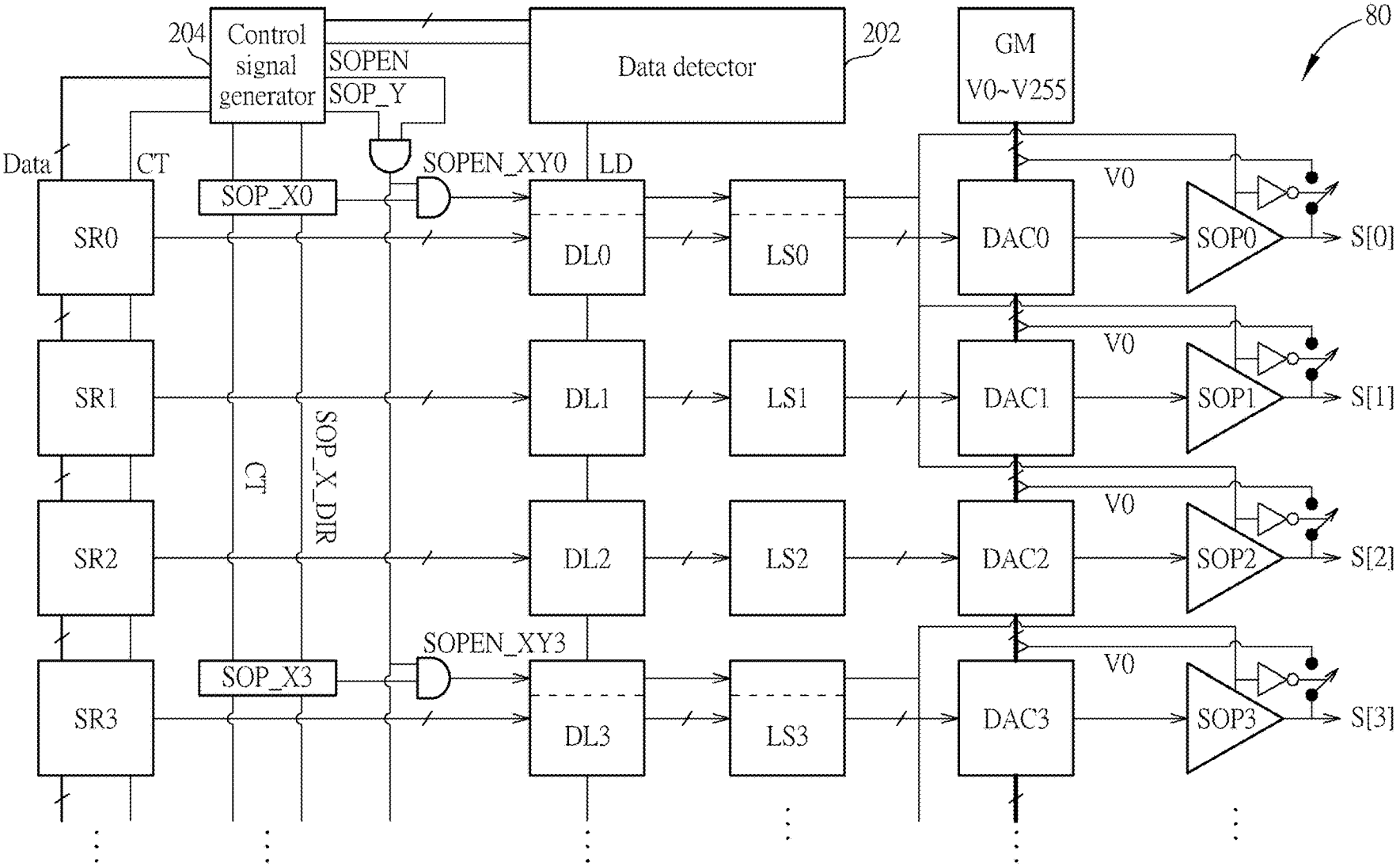
FIG. 8 is a schematic diagram of a display system according to an embodiment of the present invention.

In another embodiment, several operational amplifiers in different channels may share one control signal. Please refer to FIG. 8, which is a schematic diagram of a display system 80 according to an embodiment of the present invention. As shown in FIG. 8, the structure of the display system 80 is similar to the structure of the display system 20 shown in FIG. 2, so signals and elements having similar functions are denoted by the same symbols. The display system 80 is different from the display system 20 in that, every three operational amplifiers share one control signal. For example, the enable control signal SOPEN_XY0 is configured to control the configurations of the operational amplifiers SOP0, SOP1 and SOP2; that is, to control the operational amplifiers SOP0, SOP1 and SOP2 to be enabled or disabled. Similarly, the structure and implementation of two or more operational amplifiers sharing the same control signal may also be applicable to other control methods as those illustrated in FIG. 4 or FIG. 5. Also, the Y-direction control signal SOP_Y in this embodiment may be omitted, and the operational amplifiers may be controlled by the X-direction control signals SOP_X0, SOP_X3 . . . , respectively.

Figure 9A:
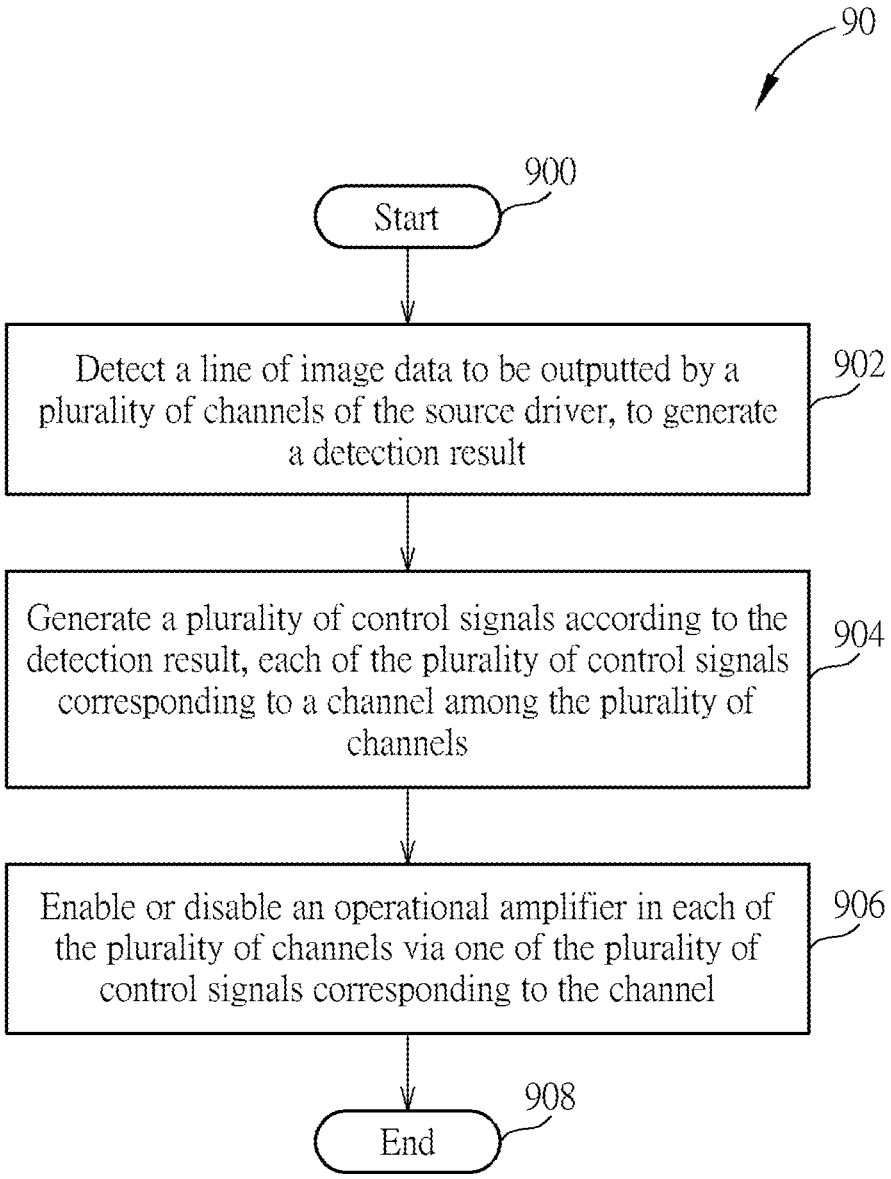
FIGS. 9A, 9B and 10 are flowcharts of a process according to embodiments of the present invention.

The abovementioned power saving control scheme and the implementations of the data detector and the control signal generator may be summarized into a process 90, as shown in FIG. 9A. The process 90 may be realized in a display system such as the display system 20, 40, 70 or 80, for detecting image data to enable or disable the output operational amplifiers of the source driver. The process 90 includes the following steps:

Step 900: Start.

Step 902: Detect a line of image data to be outputted by a plurality of channels of the source driver, to generate a detection result.

Step 904: Generate a plurality of control signals according to the detection result, each of the plurality of control signals corresponding to a channel among the plurality of channels.

Step 906: Enable or disable an operational amplifier in each of the plurality of channels via one of the plurality of control signals corresponding to the channel.

Step 908: End.

Figure 9B:
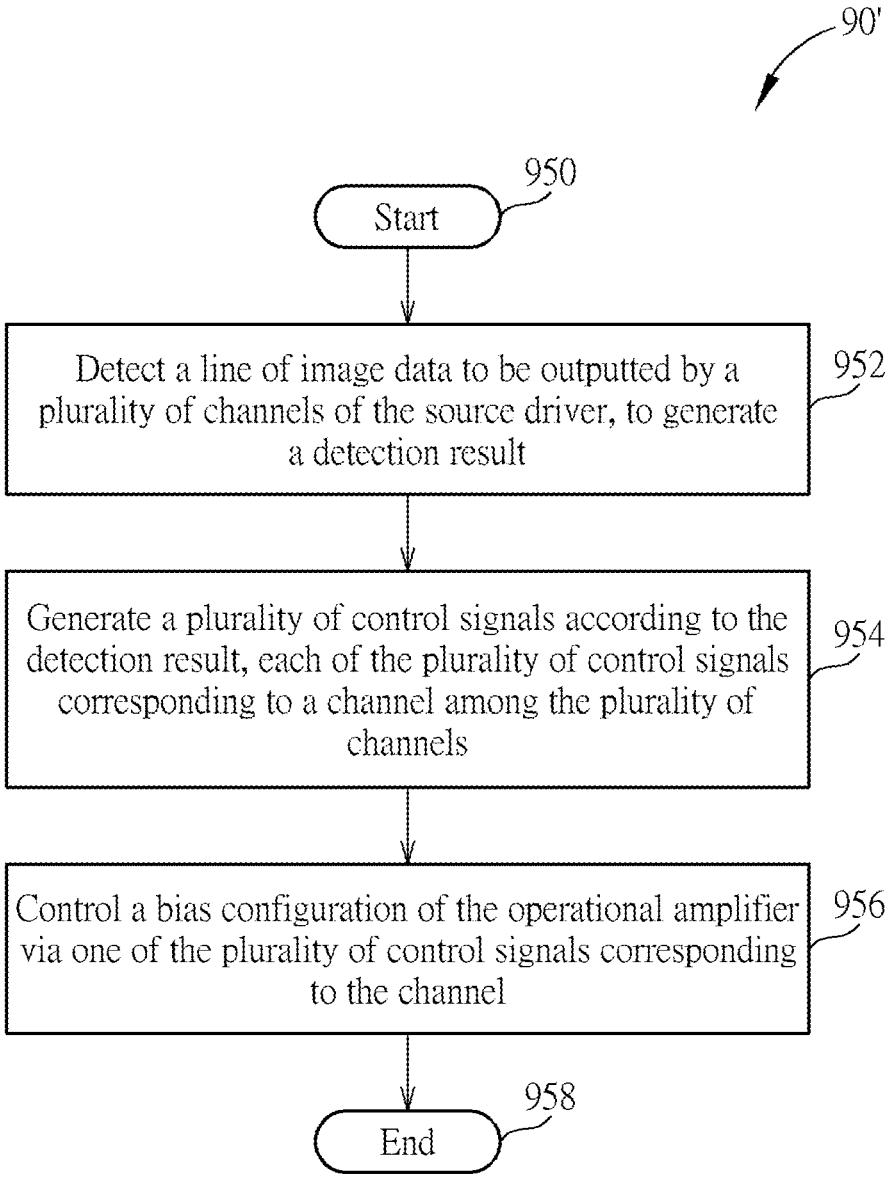

In another embodiment, the control signals may instruct the bias configurations of the operational amplifiers rather than disabling the operational amplifiers to achieve power saving. The related power saving control scheme and the implementations of the data detector and the control signal generator may be summarized into a process 90', as shown in FIG. 9B. The process 90' may be realized in a display system such as the display system 50, for detecting image data to control the bias configurations of the output operational amplifiers of the source driver. The process 90' includes the following steps:

Step 950: Start.

Step 952: Detect a line of image data to be outputted by a plurality of channels of the source driver, to generate a detection result.

Step 954: Generate a plurality of control signals according to the detection result, each of the plurality of control signals corresponding to a channel among the plurality of channels.

Step 956: Control a bias configuration of the operational amplifier via one of the plurality of control signals corresponding to the channel.

Step 958: End.

Figure 10:
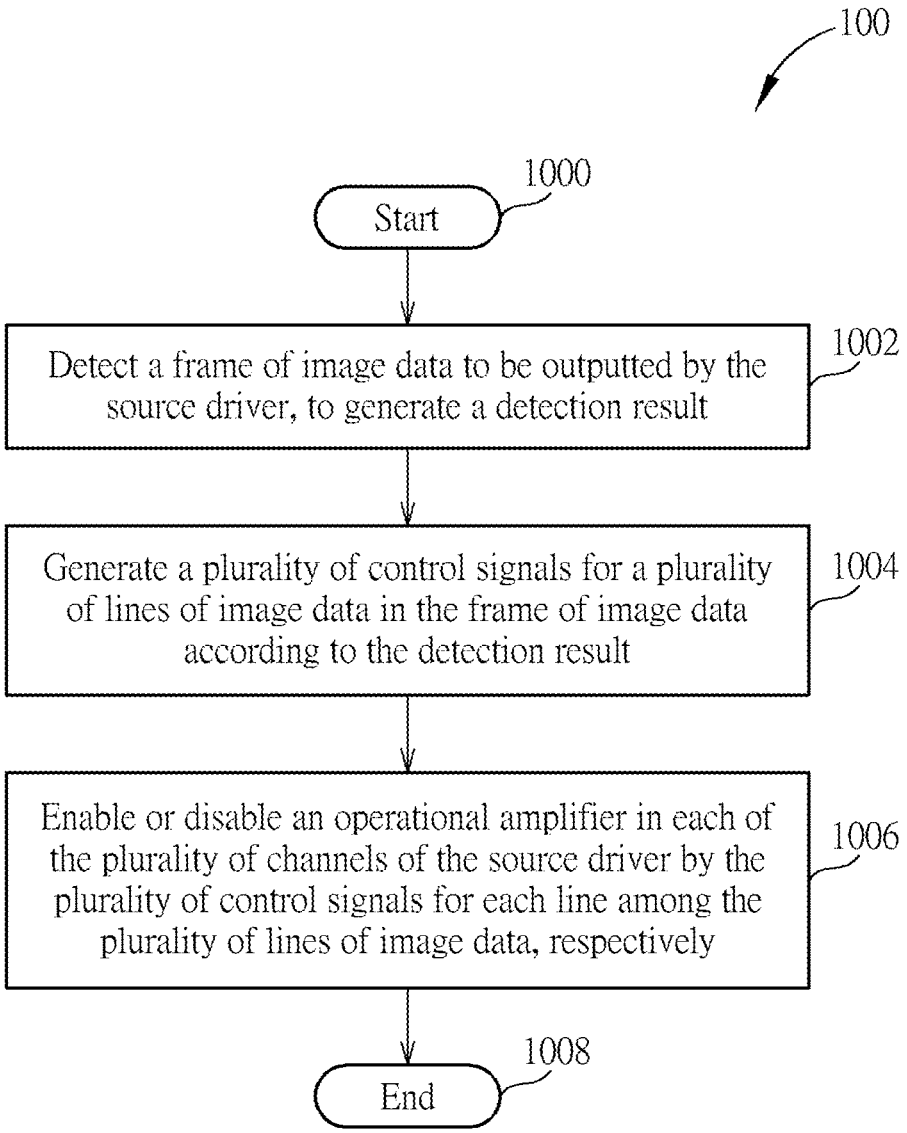

The power saving control scheme in the frame view point may be summarized into another process 100, as shown in FIG. 10. The process 100 may be realized in a display system such as the display system 20, 40, 70 or 80, for detecting a frame of image data to control the configuration of output operational amplifiers of the source driver. The process 100 includes the following steps:

Step 1000: Start.

Step 1002: Detect a frame of image data to be outputted by the source driver, to generate a detection result.

Step 1004: Generate a plurality of control signals for a plurality of lines of image data in the frame of image data according to the detection result.

Step 1006: Enable or disable an operational amplifier in each of the plurality of channels of the source driver by the plurality of control signals for each line among the plurality of lines of image data, respectively.

Step 1008: End.

To sum up, the present invention provides a power saving control method for a source driver and a related display system, which are capable of individually controlling each operational amplifier in the source driver. In detail, the data detector may detect the image data and determine the area in the image frame where power saving configuration may be applied. In an embodiment, the power saving configuration is performed on the operational amplifier(s) if the corresponding image is a specific color, e.g., black. In another embodiment, the power saving configuration is performed on the operational amplifier(s) based on comparison between the current image data and the previous image data outputted by the same channel. The power saving configuration may disable the operational amplifier when no driving capability is required to output the image. Alternatively, the operation amplifier may be configured to receive bias signals generating low bias currents, so as to reduce power consumption. Each operational amplifier in the source driver may be controlled independently and individually, to achieve the flexibility of power saving control. In an embodiment, a 2-dimensional power saving control scheme by using X-direction control signals or optionally including a Y-direction control signal is applied to realize the independent control of each operational amplifier.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of controlling a source driver, comprising:

detecting a line of image data to be outputted by a plurality of channels of the source driver, to generate a detection result;

generating a plurality of control signals according to the detection result, each of the plurality of control signals corresponding to a channel among the plurality of channels;

enabling or disabling an operational amplifier in each of the plurality of channels via one of the plurality of control signals corresponding to the channel;

for a first channel among the plurality of channels having a first image data among the line of image data, when the first image data indicates a black image, disabling the operational amplifier in the first channel and controlling the first channel to output the black image from a gamma circuit without passing through the operational amplifier of any of the plurality of channels; and for a second channel among the plurality of channels having a second image data among the line of image data, when the second image data indicates an image other than the black image, enabling the operational amplifier in the second channel and controlling the second channel to output the second image data through the operational amplifier in the second channel.

2. The method of claim 1, wherein the step of enabling or disabling the operational amplifier in each of the plurality of channels via one of the plurality of control signals corresponding to the channel comprises:

disabling the operational amplifier and controlling the channel to output an image data corresponding to the channel among the line of image data from a digital to analog converter without passing through the operational amplifier when a variation of the image data is less than a threshold.

3. The method of claim 1, wherein the step of enabling or disabling the operational amplifier in each of the plurality of channels via one of the plurality of control signals corresponding to the channel comprises:

disabling the operational amplifier and controlling the channel to output an image data corresponding to the channel among the line of image data from a digital to analog converter without passing through the operational amplifier when the image data is identical to a previous image data outputted by the channel.

4. The method of claim 1, wherein a control signal among the plurality of control signals for controlling the operational amplifier of a first channel among the plurality of channels is independent to another control signal among the plurality of control signals for controlling the operational amplifier of a second channel among the plurality of channels.

5. The method of claim 1, wherein each of the plurality of control signals is a combination of a first direction control signal and a second direction control signal, wherein the first direction control signal is configured to control the operational amplifier in each of the plurality of channels for a horizontal line of image, and the second direction control signal is configured to control the respective operational amplifier in one of the plurality of channels.

6. The method of claim 1, further comprising:

shifting a voltage level of each of the plurality of control signals to conform to a voltage level of the operational amplifier, allowing each of the plurality of control signals to enable or disable the operational amplifier corresponding to the channel.

7. A method of controlling a source driver, comprising:

detecting a line of image data to be outputted by a plurality of channels of the source driver, to generate a detection result;

generating a plurality of control signals according to the detection result, each of the plurality of control signals corresponding to a channel among the plurality of channels; and controlling a bias current of the operational amplifier via one of the plurality of control signals corresponding to the channel.

8. The method of claim 7, wherein the operation amplifier is configured to receive a first bias signal when a variation of the image data is greater than a threshold, and configured to receive a second bias signal generating a second bias current smaller than a first bias current generated by the first bias signal when the variation of the image data is less than the threshold.

9. The method of claim 7, wherein a control signal among the plurality of control signals for controlling the operational amplifier of a first channel among the plurality of channels is independent to another control signal among the plurality of control signals for controlling the operational amplifier of a second channel among the plurality of channels.

10. The method of claim 7, wherein each of the plurality of control signals is a combination of a first direction control signal and a second direction control signal, wherein the first direction control signal is configured to control the operational amplifier in each of the plurality of channels for a horizontal line of image, and the second direction control signal is configured to control the respective operational amplifier in one of the plurality of channels.

11. The method of claim 7, further comprising:

shifting a voltage level of each of the plurality of control signals to conform to a voltage level of the operational amplifier, allowing each of the plurality of control signals to control the bias current of the operational amplifier corresponding to the channel.

12. A method of controlling a source driver, the source driver comprising a plurality of channels, the method comprising:

detecting a frame of image data to be outputted by the source driver, to generate a detection result;

generating a plurality of control signals for a plurality of lines of image data in the frame of image data according to the detection result;

enabling or disabling an operational amplifier in each of the plurality of channels of the source driver by the plurality of control signals for each line among the plurality of lines of image data, respectively;

for a first channel among the plurality of channels having a first image data among the plurality of lines of image data, when the first image data indicates a black image, disabling the operational amplifier in the first channel and controlling the first channel to output the black image from a gamma circuit without passing through the operational amplifier of any of the plurality of channels; and for a second channel among the plurality of channels having a second image data among the line of image data, when the second image data indicates an image other than the black image, enabling the operational amplifier in the second channel and controlling the second channel to output the second image data through the operational amplifier in the second channel;

wherein each of the plurality of control signals is configured to control the operational amplifier in one of the plurality of channels for a line of image data among the plurality of lines of image data.

* * * * *